United States Patent [19]

Vering et al.

[11] 3,975,147

[45] Aug. 17, 1976

[54] ROTARY KILN

[75] Inventors: Antonius Vering, Vorhelm; Bernhard Loffler, Warendorf, both of Germany

[73] Assignee: Polysius AG, Neubeckum, Germany

[22] Filed: May 14, 1975

[21] Appl. No.: 577,197

[30] Foreign Application Priority Data

May 17, 1974 Germany ..... 2424224

[52] U.S. Cl. ..... 432/80; 432/106

[51] Int. Cl.[2] ..... F27B 7/02; F27B 7/38

[58] Field of Search ..... 432/80, 106, 245

[56] References Cited

UNITED STATES PATENTS

| | | | |
|---|---|---|---|
| 3,502,139 | 3/1970 | Andersen | 432/80 |
| 3,840,335 | 8/1974 | Deussner | 432/80 |
| 3,844,709 | 10/1974 | Ghestem | 432/80 |
| 3,859,039 | 1/1975 | Heinemann et al. | 432/80 |

*Primary Examiner*—John J. Camby
*Assistant Examiner*—Henry C. Yuen

[57] ABSTRACT

This invention relates to a rotary kiln for the heat treatment of material and having a number of elongate satellite cooling tubes distributed uniformly around the rotary kiln periphery at the exit end of the kiln, the inlet ends of these tubes being connected by short inlet pipes to the interior of the rotary kiln, and each tube being supported on the rotary kiln casing by two support bearings which accommodate axial movement of the tubes relative to the kiln occasioned by thermal expansion or contraction of the tubes. Mounting of the bearing means accommodates a close spacing between adjacent tubes.

10 Claims, 7 Drawing Figures

ROTARY KILN

With rotary kilns of the type described, especially with those of large dimensions, thermal expansions occur between individual components, for instance between the actual rotary kiln and the cooling tubes distributed thereabout, these expansions being due to differing temperatures in the individual components and requiring compensation by design features.

For this reason it is known in practice for the rearmost support bearing, as seen in the feed direction of the material, of each satellite cooling tube to be attached firstly direct to the rotary kiln casing and secondly to the cooling tube in such manner that the cooling tube in this region can move axially while supported and is thus supported on the rotary kiln casing. In the vicinity of the inlet end of each satellite cooling tube there is however provided a support bearing which is firmly, or rigidly, connected to the rotary kiln casing. Here the inlet pipes of the satellite cooling tubes are used only for feeding the material to be cooled, from the interior of the rotary kiln into the individual satellite cooling tubes, without thereby performing any support function. It has however now been found that at the attachment points in particular the foremost support bearings fixedly attached to the rotary kiln casing (in the area of the inlet ends of the satellite cooling tubes), because of the large and constantly changing mechanical stressing of the rotary kiln by the loading on the cooling tube and by the thermal expansions occurring are in time subject to cracks and even permanent breaks, so that proper support of the satellite cooling tubes can no longer be ensured.

A rotary kiln construction is also known wherein the satellite cooling tubes are fixedly attached by their inlet pipes to the rotary kiln, and also spaced along the length of each satellite cooling tube there are two support bearings, movably connected both to the rotary kiln casing and to the exterior of the cooling tube so that the satellite cooling tube support enables them to move axially. In this known construction the joint between the support bearing and the rotary kiln casing is provided by a hinge axis, while the joint between a cooling tube exterior and the support bearing is formed by cambered surfaces in the support bearing having interposed straight pins. Thus in the region between two adjacent satellite cooling tubes in the peripheral direction of the rotary kiln there is always provided a front and a rear support bearing, so that practically all the satellite cooling tubes are more or less rigidly interconnected, and are movable. A serious disadvantage of this known construction is seen in that because of the described attachment of the satellite cooling tubes to the rotary kiln casing, with differing thermal expansions of the satellite cooling tubes in the axial direction, caused by differing temperatures, random forces can be transmitted to the individual support bearings, and these forces have a particularly unfavorable effect, especially when the individual cooling tubes are just beside the rotary tube during movement of the rotary kiln.

The invention is thus based on the problem of avoiding the defects of the known constructions in providing satellite cooling tubes for rotary kilns of the type described initially, which though of relatively simple construction ensure reliable and durable attachment of the support bearings.

According to the invention this problem is solved in that the foremost support bearing provided at the inlet end of each satellite cooling tube is fixedly attached to the cooling tube exterior but is adapted to pivot on the rotary kiln casing, permit axial movement of the tubes relative to the kiln, and in that at least one annular rim for the front and rear support bearings is affixed to the periphery of the rotary kiln casing in order to support all the satellite cooling tubes.

With the construction provided by the invention, the front support bearing (as seen in the feed direction of the material) of each satellite cooling tube provides to some extent a semi-rigid attachment of the cooling tube inlet end to the rotary kiln casing. Since the front support bearing is fixedly attached to the cooling tube exterior and hingedly attached to the rotary kiln casing, the corresponding satellite cooling tube is held substantially stabilized in the longitudinal direction of the rotary kiln, though it can take part in changes of spacing from the rotary kiln casing in the vicinity of the rear support bearing, which may arise from axial displacements caused by thermal changes.

Since the individual bearing supports with the rotary kiln provided by the invention are not applied directly to the kiln casing, as with known constructions, but to annular rims which in turn are affixed to the periphery of the rotary kiln casing, firstly cross-sectional deformations of the rotary kiln in the area of the support points are largely avoided or at least reduced to a minimum, and secondly the connections between the kiln casing and the bearing supports are formed by elements which are subject to lower thermal stresses.

Thus extremely reliable and durable support of the individual satellite cooling tube on the rotary kiln casing is ensured by these features provided in accordance with the invention.

In a preferred further development of the invention, each satellite cooling tube is annularly clamped by its front support bearing, while the rear support bearing is forkshaped and is pivotally mounted both to the cooling tube and to the rotary kiln casing. Each front and rear support bearing can be pivotally mounted by at least one axial bolt or pivot pin to the bearing head attached to the corresponding rim. The pivotal bearing joints between the bearing supports and the rotary kiln casing for both the front and rear bearings support may advantageously be made of similar design.

The invention is described in more detail below in relation to the embodiment shown in the drawings, wherein.

Figure 1:
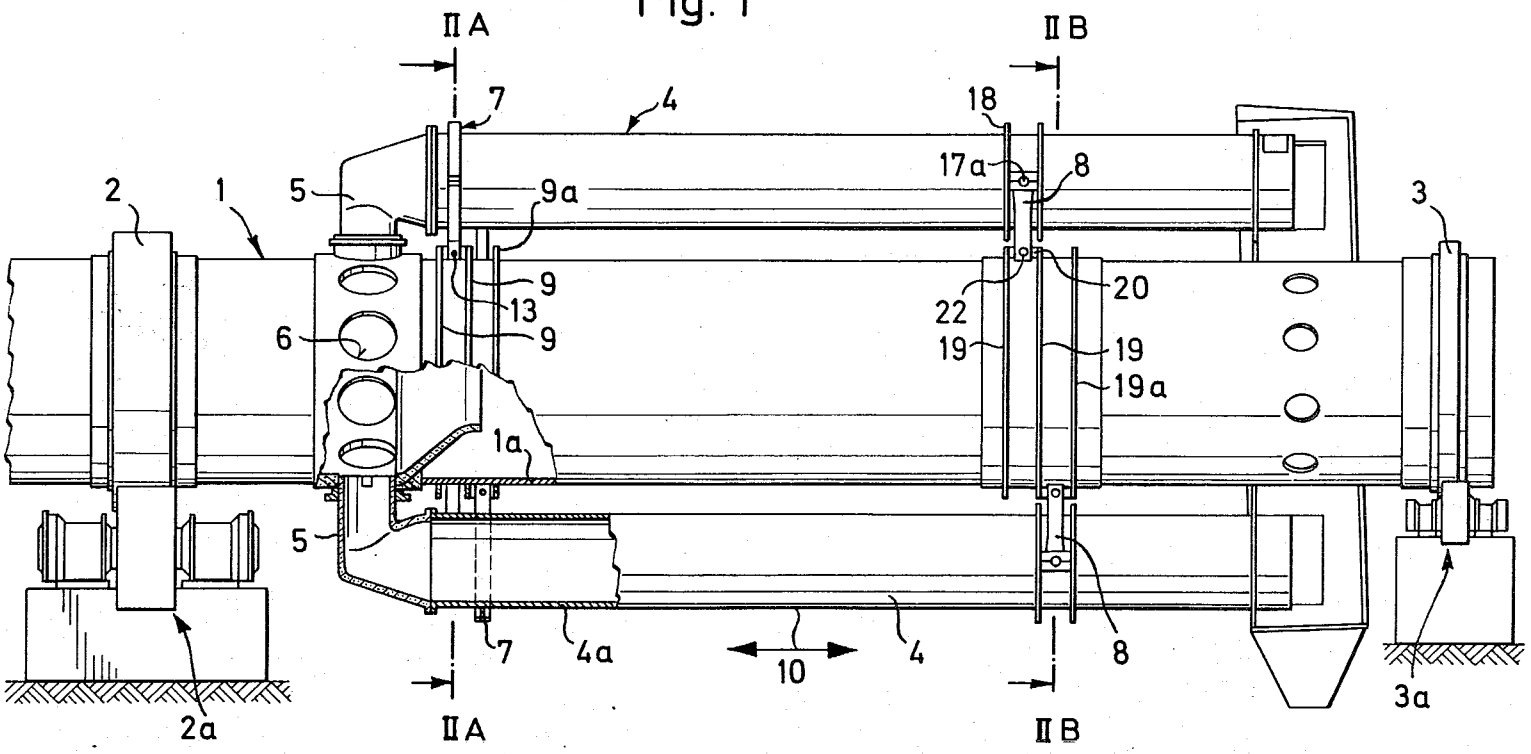
FIG. 1 is a partially sectioned view of the outlet end of a rotary kiln in accordance with the invention.

FIG. 1 shows the outlet end of a rotary kiln 1 used for the heat treatment of material. At the exit end of the kiln 1 the rotary tube portion 1a thereof has two barrel rings 2, 3 supported in the usual manner by bearing roller stations 2*a*, 3*a*.

A number of satellite cooling tubes are uniformly distributed around the periphery of the rotary kiln. Each cooling tube 4 is connected at its inlet end to the interior of the rotary kiln by a short inlet pipe 5 and by apertures 6 provided in the casing of the rotary tube portion 1a.

The individual satellite cooling tubes 4 are each supported on the casing of the rotary tube 1*a* by a front mounting device on support bearing 7 disposed in the vicinity of the inlet end, and by a rear mounting device or support bearing 8 lying rearwards, as seen in the feed direction of the material.

Figure 2A:
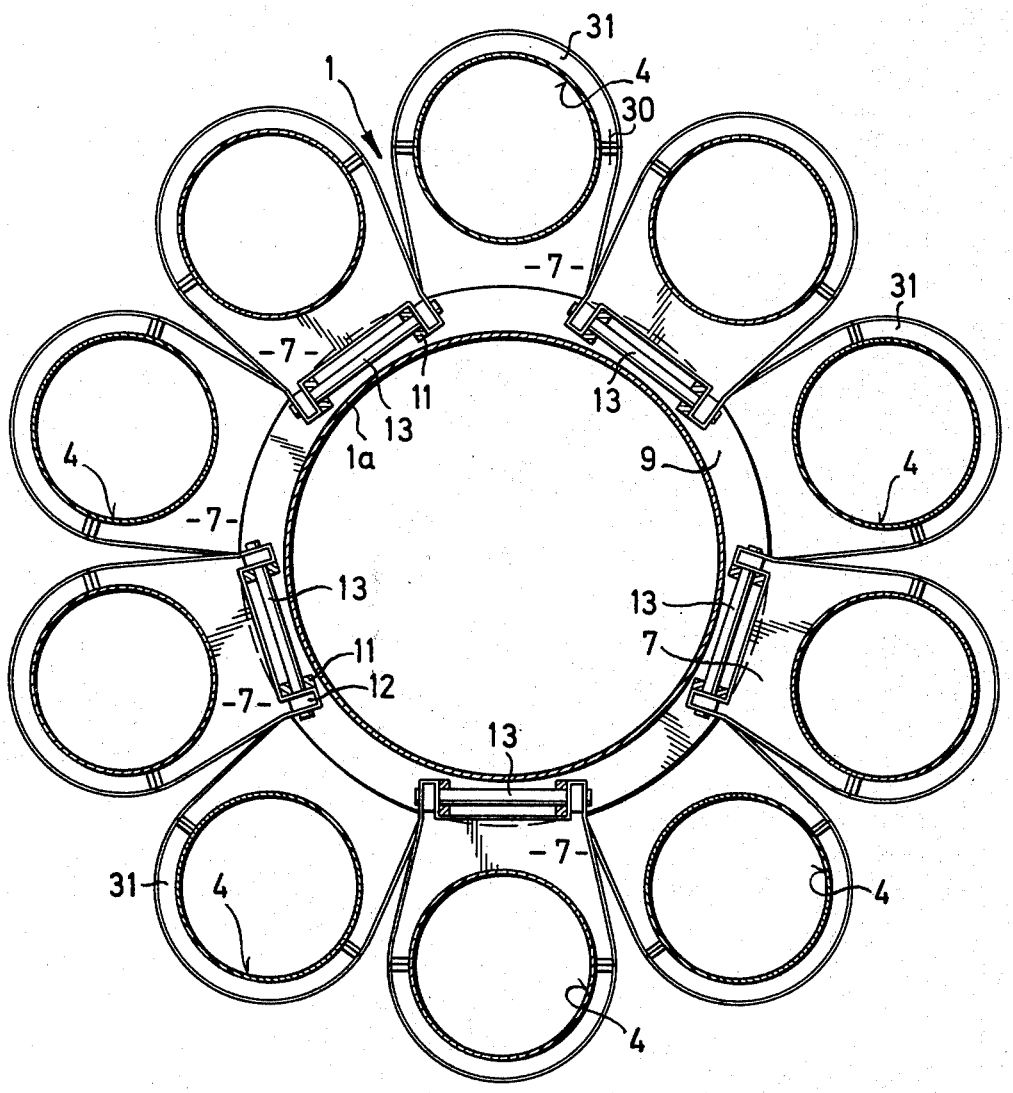
FIGS. 2A and 2B are a simplified cross-sections through the outlet end of the kiln along the lines 11A-11A and 11B-11B in FIG. 1.
Figure 2B:
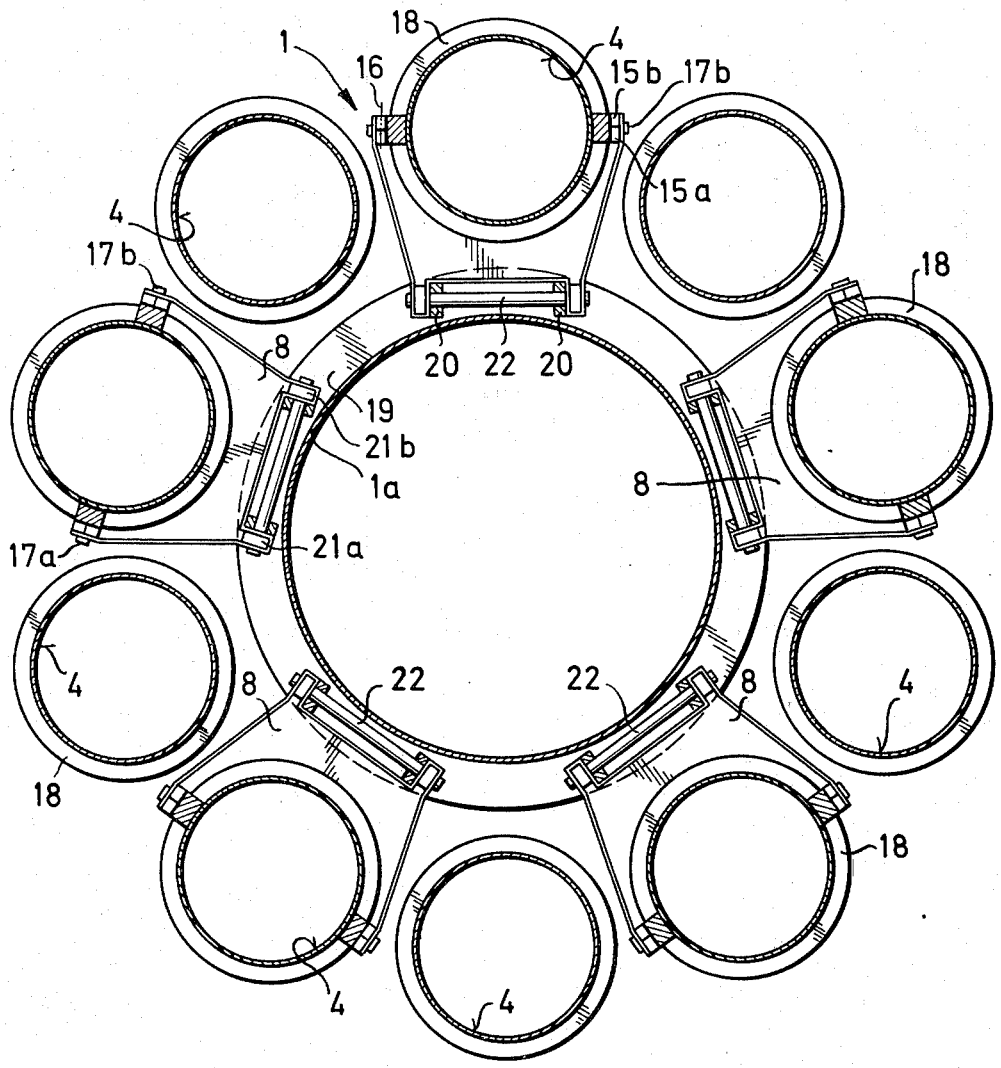
Figure 3B:
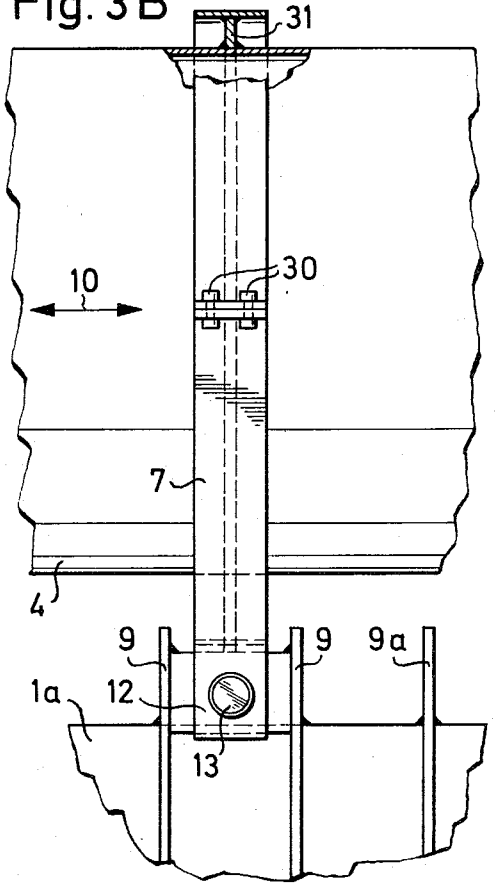
FIGS. 3A and 3B are two partial views on enlarged scale, showing the construction of a front support bearing in accordance with the invention.
Figure 3A:
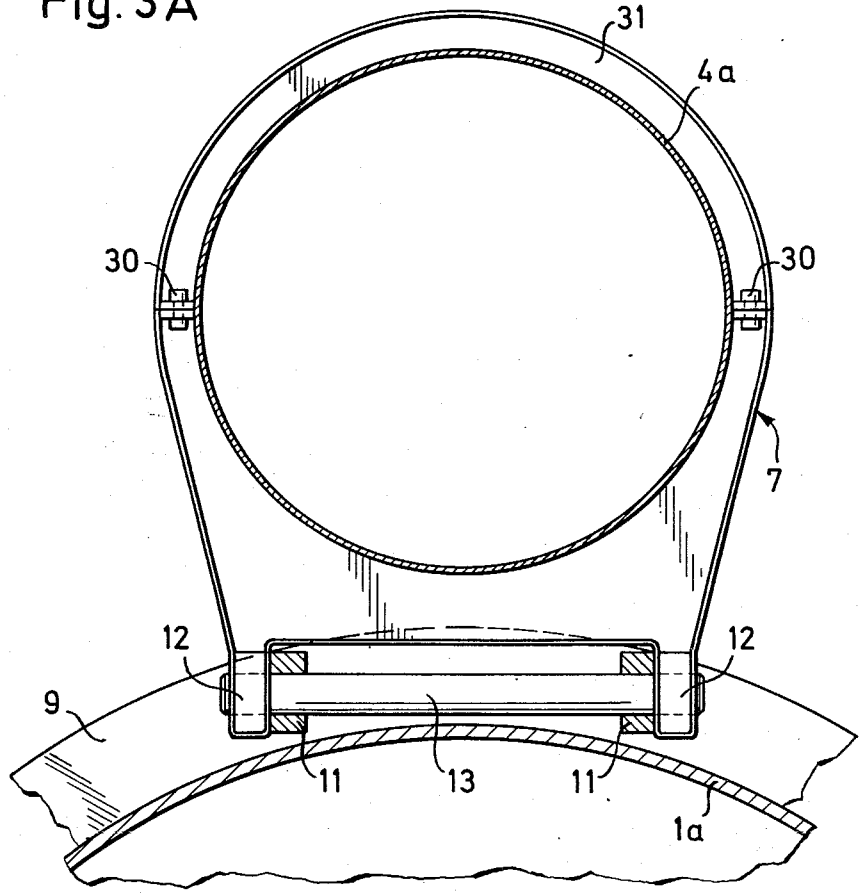
Figure 4B:
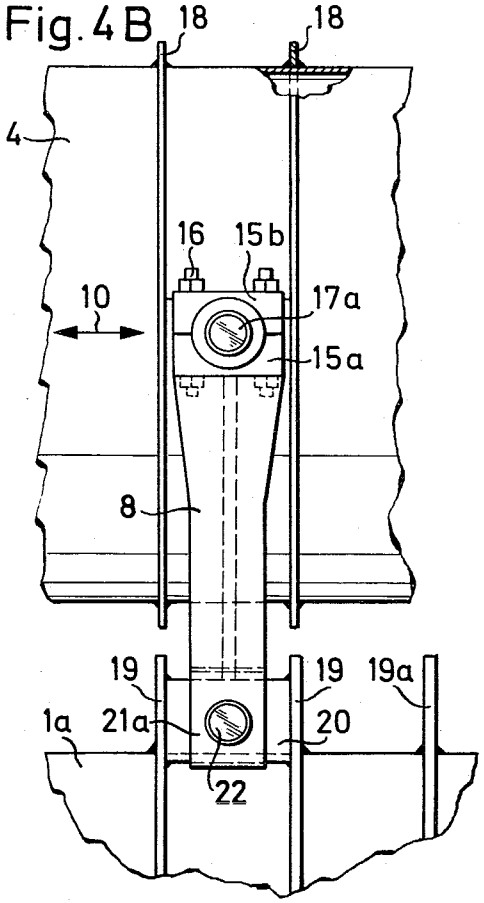
FIGS. 4A and 4B are partial views on enlarged scale, showing the construction of a rear support bearing.
Figure 4A:
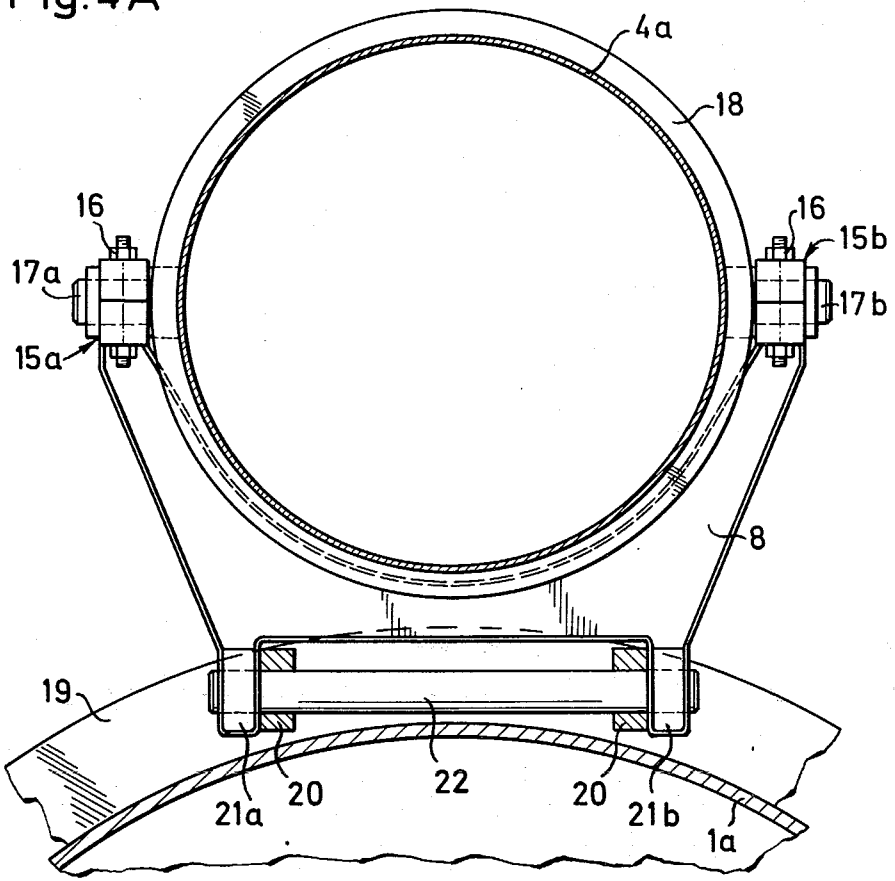

As may be clearly seen from FIGS. 1, 2 (lower half), 3A half), 3A 3B, each satellite cooling tube 4 is annularly and rigidly enclosed in its front support bearing 7 by an annular clamp assembly, so producing a firm and rigid connection between the support bearing 7 and the cooling tube exterior 4*a*. As shown in FIGS. 3A and 3B, the side 31 of the support bearing 7 remote from the rotary kiln casing can be removably attached as at 30 to make for easier insertion of the cooling tube. For the connection between the front support bearing 7 and the casing of the rotary tube portion 1a there is affixed to the periphery of this tube portion at least one annular rim or web 9, whereby a joint pivotally movable in the axial direction (see double arrow 10) can be formed between the rotary kiln casing and the front support bearing 7.

In the example shown, a web assembly 9 for the rotary kiln casing is formed of two edge-mounted rings made of flat steel strip, of similar construction and affixed to the rotary kiln casing with a parallel axial spacing. Between the two webs are affixed bearing blocks 11 having their bores aligned with the bores of the bearing guides or bearing eyes 12 of the front support bearing 7 (see FIG. 3A).

A continuous axial pin 13 passes through the bores in the bearing blocks 11 and the bearing eyes 12, so producing a pivotal connection between the support bearing 7 and the rotary kiln casing. This pivotal connection could naturally also be formed by two short axial bolts in the area of each bearing eye 12, in which case a bearing block (similar to 11) is provided at each side of a bearing eye 12.

Since, as seen especially from FIG. 2, the individual satellite cooling tubes 4 may have to be disposed relatively close together in the peripheral direction, in such cases the pivotal connections between the support bearings 7 and the common rim 9 on the kiln casing leads to difficulties in design or at least in assembly. For this reason the support bearings 7 of two satellite cooling tubes 4 adjacent each other in the peripheral direction of the rotary tube element 1*a* are affixed to the corresponding cooling tube exteriors 4*a* with an axial offset from each other. In such case an axially displaced web can be provided on the periphery of the rotary kiln casing in addition to the first rim, with the axial displacement or the interval to this second rim corresponding to the axial displacement from each other of the support bearings 7 for the adjacent cooling tubes.

In the embodiment shown (see especially FIGS. 1 and 3B), the two webs for the front support bearings 7 are formed by the two webs 9 standing on edge and by an additional web 9*a*, formed in the same manner as the webs 9 and affixed to the kiln casing at an axial distance from the adjacent web 9 equal to that between the two webs 9. Thus bearing blocks for the pivotal connections of a first group of front support bearings are affixed between the two rim rings 9 while the bearing block for the offset group of front support bearings 7 is affixed between the centre rim ring 9 and the additional rim ring 9*a*.

In contrast with the front support bearings 7, the rear support bearings 8 of the satellite cooling tubes 4 are also pivotally connected to the corresponding cooling tube exteriors, as may be seen from FIGS. 1, 2, 4A and 4B. Each rear cooling tube support bearing 8 is of general forkshape (see FIG. 4A) and at its ends remote from the cooling tube has bearings 15*a*, 15*b* each consisting of two bearing shells held together with bolts 16. In each bearing 15*a*, 15*b* is mounted an axle journal in the form of pivot pins 17*a*, 17*b* affixed to the corresponding cooling tube casing 4*a* by an annular rim 18. The pins 17*a* and 17*b* extend radially of the tube 4 and are affixed diametrically opposite so that they lie in a plane perpendicular to the rotary kiln axis. The annular web 18 for the attachment of the pins 17*a*, 17*b* may also be made in simple manner either as two flat steel strip rings disposed on edge a distance from each other, or as a suitably formed profiled ring.

As shown, the other end of the rear support bearing 8 may project and be pivotally mounted to the casing of the rotary kiln 1, like the corresponding end of the front support bearing 7. Thus again a web 19 is affixed to the periphery of the rotary kiln casing, and comprises two flat steel strip rings spaced apart from each other, with bearing blocks 20 affixed between them. At this end the rear support bearing 8 again has two bearing eyes or guide projections 21*a*, 21*b* having bores coaxial with each other and which are aligned with the bearing blocks 20, so that either a continuous axial pin 22 (as shown) can be inserted through the bores in the bearing blocks 20 and the bearing eyes 21*a*, 21*b*, or if desired two short axial bolts in the vicinity of the bearing eyes.

If the satellite cooling tubes 4 are arranged relatively close together in the peripheral direction of the rotary kiln, then exactly as with the front support bearings 7, the rear support bearings 8 of adjacent satellite cooling tubes 4 are axially offset from each other, whereupon in order to hold these offset support bearings 8 there is affixed to the casing of the rotary kiln 1a an additional web, for which purpose in this embodiment a third flat steel strip ring 19*a* is affixed to the rotary kiln casing, spaced axially apart from the adjacent central web 19, so that bearing blocks 20 can be placed between. As will be noted from earlier comments, in this embodiment the rear support bearings 8 are formed as double swing supports, being pivotally mounted both on the rotary kiln casing and on the cooling tube casing, so that while providing reliable support for the satellite cooling tubes 4 they readily permit axial displacement (e.g. through thermal expansion). With these axial displacements of the satellite cooling tubes, the pivotal mounting permits a type of change in the flight circle of the satellite cooling tubes 4, but this can easily be compensated by the hinged attachment of the front support bearings 7 to the rotary kiln casing, without any undesired stresses being able to arise at the connection points, of the type which could lead to cracks and finally to breaks in the case of fixed, i.e. rigid, joints between the front support bearings 7 and the rotary kiln casing.

With the construction in accordance with the invention, a particularly favorable effect is also produced by the fact that both the front and the rear support bearings 7 and 8 are constructed practically as individual supports, so that each satellite cooling tube 4 can undergo relative shifts caused for instance by temperature changes independently of the others.

What is claimed is:

1. In a rotary kiln having a plurality of satellite cooling tubes distributed uniformly around the periphery of said kiln, each of said cooling tubes having an inlet at one end thereof in communication with the interior of said kiln, the improvement comprising a pair of mounting devices for each of said cooling tubes to couple the latter to said kiln at axially spaced points, pivotal means connecting at least one of said pair of mounting devices to said kiln, and pivotal means connecting the other of said pair of mounting devices to said cooling tube, the respective pivotal means defining pivotal axes enabling relative axial movement of said cooling tubes and said kiln.

2. The invention defined in claim 1 including additional pivotal means connecting the other of said pair of mounting means to said kiln.

3. In a rotary kiln having a plurality of satellite cooling tubes distributed uniformly around the periphery of the kiln, relatively short inlet tubes connecting said cooling tubes at one end thereof to the interior of the kiln, and first and second support bearing means located respectively adjacent opposite ends of each tube supporting each cooling tube upon said kiln; the improvement comprising coupling means coupling each of said first bearing means to its cooling tube, and hinge means coupling each of said first bearing means to said kiln for pivotal movement about an axis enabling axial movement of each cooling tube relative to said kiln.

4. The invention defined in claim 3 wherein said coupling means comprises annular clamp means engaging said tube around its entire periphery.

5. The invention defined in claim 3 wherein said second support bearing means comprises a fork-like member, first pivot means coupling said fork-like member to said kiln, and second pivot means spaced from said first pivot means and coupling said member to said tube.

6. The invention defined in claim 5 wherein said second support bearing means includes an annular rim and wherein said first pivot means comprises a pair of pivot pins fixedly mounted upon and projecting radially from said rim at diametrically opposed positions, and rotary bearing means rotatively receiving said pivot pins.

7. The invention defined in claim 3 further including first and second annular flange means fixedly mounted on said kiln, bearing block means fixedly mounted on each of said flange means, and pin means pivotally coupling said first and second bearing means to the respective bearing block means.

8. The invention defined in claim 7 wherein each of said first and second flange means comprises at least one annular web projecting radially from said kiln.

9. The invention defined in claim 8 wherein each of said first and second flange means comprises a pair of said webs uniformly spaced from each other, said bearing block means being fixed to and extending between said pair of webs.

10. The invention defined in claim 8 wherein each of said first and second flange means comprises a group of three of said webs at uniformly spaced positions axially of said kiln, the respective bearing block means being fixedly secured to and extending between adjacent webs of each group with said bearing block means extending respectively from the central web of each group alternately to the webs on opposite sides of said central web whereby adjacent bearing block means are axially offset from each other.

* * * * *